United States Patent [19]

Kawai et al.

[11] 4,328,771

[45] May 11, 1982

[54] STARTING ASSIST SYSTEM FOR DIESEL ENGINES

[75] Inventors: Hisasi Kawai, Toyohashi; Seiji Morino, Aichi; Akira Fukami; Hiroshi Hamaguchi, both of Okazaki, all of Japan

[73] Assignee: Nippon Soken, Inc., Nishio, Japan

[21] Appl. No.: 75,678

[22] Filed: Sep. 14, 1979

[30] Foreign Application Priority Data

Oct. 31, 1978 [JP] Japan ..... 53-134128

[51] Int. Cl.[3] ..... F02P 15/10

[52] U.S. Cl. ..... 123/179 BG; 123/606; 123/637

[58] Field of Search ..... 123/179 BG, 179 B, 179 H, 123/606, 639, 649, 655, 628, 621, 607, 637

[56] References Cited

U.S. PATENT DOCUMENTS

| | | | |
|---|---|---|---|
| 2,061,826 | 11/1936 | Bremser | 123/298 |
| 3,368,540 | 2/1968 | Ault | 123/179 BG |
| 3,606,873 | 9/1971 | Rademacher et al. | 123/179 BG |
| 3,780,717 | 12/1973 | Rakitch | 123/621 |
| 3,795,236 | 3/1974 | Jukes et al. | 123/634 |
| 3,910,247 | 10/1975 | Hartig | 123/655 |
| 3,945,362 | 3/1976 | Neuman et al. | 123/606 |
| 4,149,508 | 4/1979 | Kirk, Jr. et al. | 123/606 |
| 4,161,936 | 7/1979 | Volsky | 123/606 |
| 4,181,112 | 1/1980 | Grather et al. | 123/606 |

*Primary Examiner*—Charles J. Myhre
*Assistant Examiner*—Andrew M. Dolinar
*Attorney, Agent, or Firm*—Cushman, Darby & Cushman

[57] ABSTRACT

Spark ignition plugs are used in place of the glow plugs in a Diesel engine. As long as engine preheating contacts remain closed, pulses of a fixed frequency are applied to two transistors arranged in a push-pull configuration and connected to the primary coil of a transformer so that an engine plug connected to the secondary coil of the transformer repeatedly discharges continuously.

8 Claims, 8 Drawing Figures

STARTING ASSIST SYSTEM FOR DIESEL ENGINES

BACKGROUND OF THE INVENTION

The present invention relates to a starting assist system capable of improving the starting performance of Diesel engines.

In the Diesel engine, the ignition and burning of fuel are effected by injecting the fuel into the air heated to a high temperature by adiabatic compression, so that when particularly the cold engine (at ambient air temperatures of below 0° C.) is cranked for starting, the temperature of the adiabatically compressed air is low and the ignition of the fuel is deteriorated, thus making it difficult to start the engine without any starting assist means.

Known in the art are starting assist means of the type employing glow plugs which are inserted into the respective precombustion chambers. This means is so designed that the glow plug which is a type of electric heater is heated red hot by supplying current to it and atomized fuel is directed against the red-hot glow plug to facilitate the ignition of the fuel. In this way, the low adiabatic compression temperatures are made up by the heat generation of the glow plug.

A disadvantage of this type of known means is that the time required for heating the glow plug red hot ranges from about 15 to 30 seconds, that the operation is complicated due to the necessity to effect the preheating prior to the cranking and that the time required to start the engine is also long. There is another disadvantage that even a trivial erroneous operation tends to cause troubles such as rundown battery or engine starting failure.

SUMMARY OF THE INVENTION

The present invention has been made in view of the afore-mentioned deficiencies in the prior art, and it is an object of the invention to provide a starting assist system for Diesel engines whereby a Diesel engine can be quickly and positively started even at low temperatures, thereby overcoming the foregoing deficiencies in the prior art.

In accordance with the invention there is thus provided a starting assist system for Diesel engines comprising a spark ignition plug placed in each of the precombustion chambers of a Diesel engine; a DC power source having a pair of output terminals for generating a DC voltage; and an ignition unit for causing discharge of the spark ignition plugs by the output voltage of the DC power source when preheating contacts are closed; the ignition unit including, for each plug, a transformer having cores with gaps, a primary coil wound on the cores and having a pair of primary terminals and a center terminal and a secondary coil wound on the cores; a conductor connecting the center terminal of the transformer to one of the output terminals of the DC power source; and a pair of semiconductor switching circuits each adapted to close and open the section between its switch terminals in response to input pulse signals which are applied to the switching circuits in phase opposition, the switching circuits having their one switch terminals each connected to associated one of the transformer primary terminals and their other switch terminals connected in common to the other output terminal of the DC power source, the switching circuits each being adapted to block a primary current due to the back electromotive force produced in the primary coil, whereby a trigger high voltage and a continuous discharge voltage are periodically generated and applied to the spark ignition plug from the secondary coil, and the previously mentioned deficiencies in the prior art are overcome by this construction.

DESCRIPTION OF THE PREFERRED EMBODIMENTS

The present invention will now be described in greater detail with reference to the illustrated embodiments.

Figure 1:
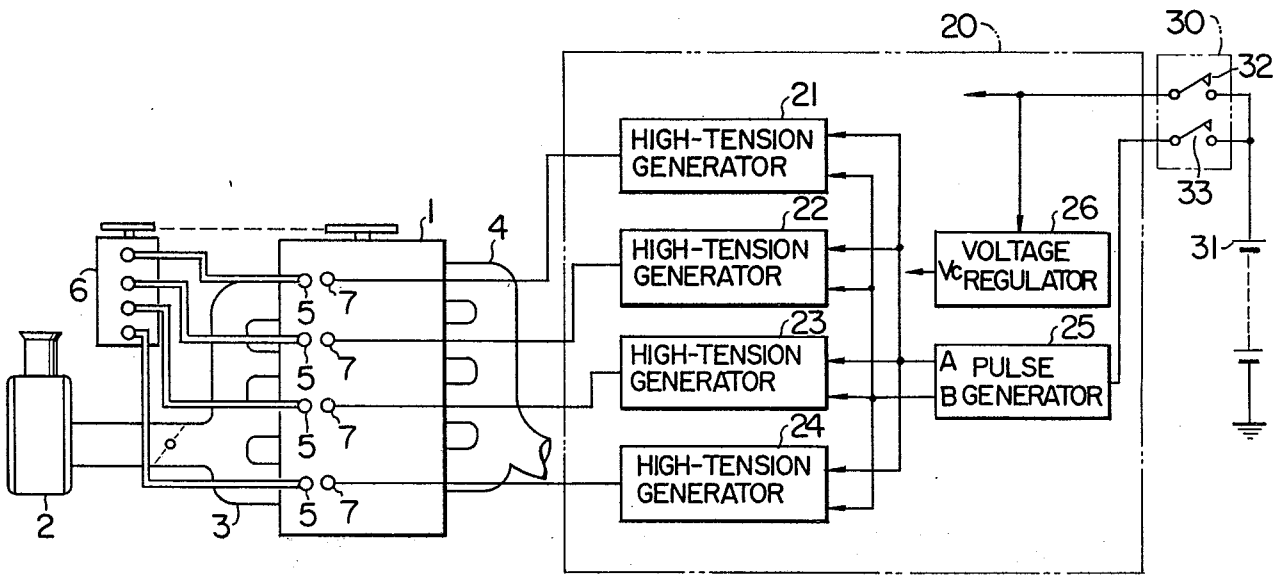
FIG. 1 is a schematic block diagram showing the overall construction of an embodiment of the invention.

Referring to FIG. 1 showing a first embodiment of the invention, attached to the intake system of a four-cylinder Diesel engine 1 are an air cleaner 2 and an intake manifold 3, and an exhaust manifold 4 is attached to the exhaust system of the engine 1.

The fuel is supplied through fuel injection valves 5 mounted in the respective cylinders and the fuel is force-fed to the fuel injection valves 5 from a known type of fuel injection pump 6. A spark ignition plug 7 of the type generally used in gasoline engines, is mounted near each of the fuel injection valves 5.

Figure 2:
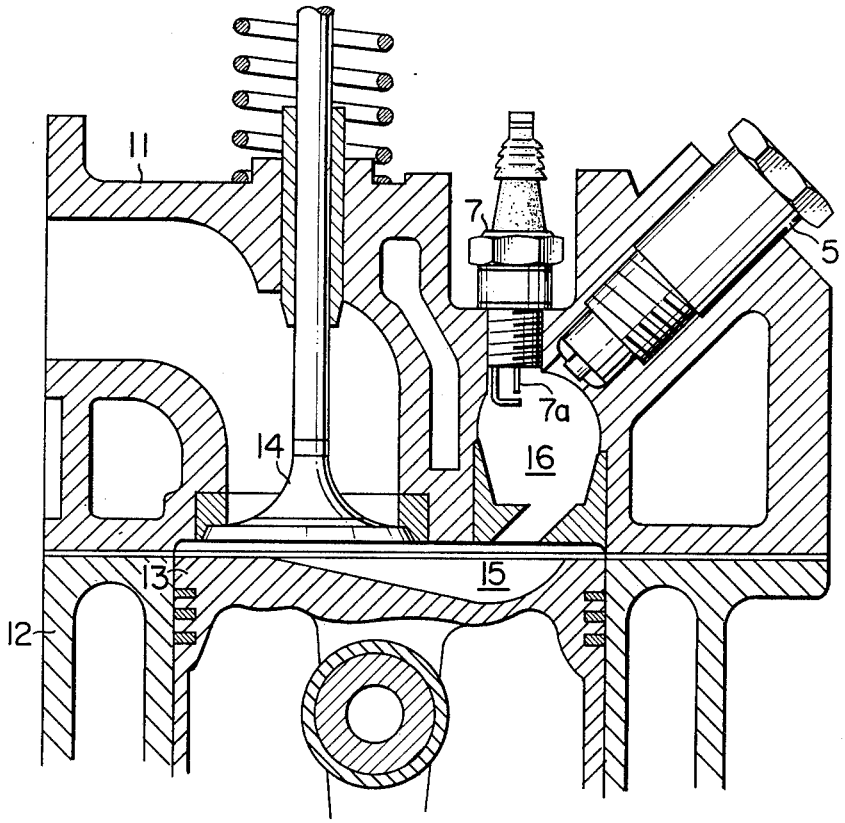
FIG. 2 is a longitudinal sectional view of the engine shown in FIG. 1.

The cylinders of the Diesel engine 1 are each constructed as shown in FIG. 2 and the cylinder comprises a cylinder head 11, a cylinder block 12, a piston 13, an exhaust valve 14, an intake valve (not shown), a main combustion chamber 15, a vortex type precombustion chamber 16 communicating with the main chamber 15, etc. The fuel injection valve 5 is fitted in the cylinder head 11 in a manner that the fuel swirls within the precombustion chamber 16 and the ignition plug 7 is mounted in the cylinder head 11 in a manner that its discharge electrode *7a* projects into the precombustion chamber 16 in the vicinity of the fuel injection valve 5.

Referring again to FIG. 1, each of the ignition plugs 7 in the respective cylinders is connected to an ignition unit 20 by a high-tension cable and the ignition unit 20 is connected through a key switch 30 to a vehicle battery 31 constituting a DC power source.

The ignition unit 20 comprises high-tension generators 21 to 24, a pulse generator 25 and a voltage regulator 26, and each of the high-tension generators 21 to 24 is connected to one of the spark plugs 7.

The pulse generator 25 is designed to generate two kinds of clock signals A and B and the clock signals A and B are applied to each of the high-tension generators 21 to 24. The voltage regulator 26 generates a fixed voltage $V_c$ and applies it as a bias voltage to the generators 21 to 25. The key switch 30 is of the known type having bias contacts 32 and preheating contacts 33 and these contacts will be opened and closed through the operation of the driver.

Next, an electric circuit of the ignition unit 20 will be described with reference to FIG. 3. The pulse generator 25 comprises a waveform reshaping circuit 51 for generating the clock signal A and an oscillator circuit 52 for generating the clock signal B. The waveform reshaping circuit 51 is of the known type which reshapes the input signal to a rectangular pulse signal. The input signal is the on-off signal generated by the preheating contacts 33. The output of the waveform reshaping circuit 51 is a timing or enabling voltage signal which goes to a "1" level in response to the closing of the preheating contacts 33 and which goes to a "0" level in response to the opening of the preheating contacts 33 as shown in (a) of FIG. 5.

Figure 5:
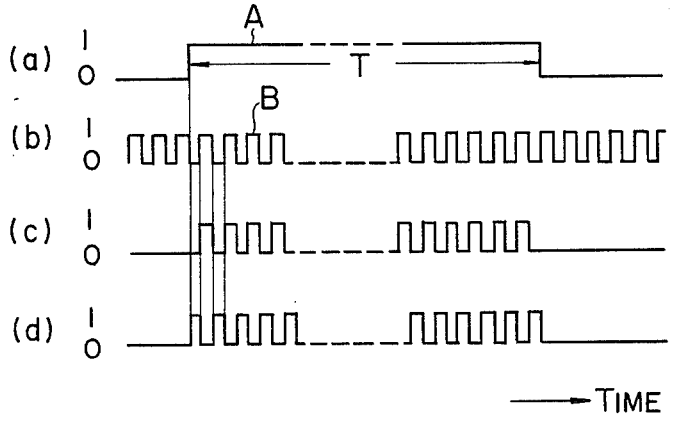
FIGS. 5 and 6 are waveform diagrams useful in explaining the operation of the embodiment of FIG. 1.

The oscillator circuit 52 comprises a known type of astable multivibrator and it generates the clock signal B consisting of rectangular pulses having a fixed frequency of about 5 kHz as shown in (b) of FIG. 5.

Next, the high-tension generator 21 will be described. An AND gate 53 is a circuit for performing the AND operation on the output signals of the waveform reshaping circuit 51 and the oscillator circuit 52, so that the output signal pulses of the oscillator circuit 52 are passed so long as a "1" level signal is being generated from the waveform reshaping circuit 51 and a "0" level signal is always generated when a "0" level signal is generated from the waveform reshaping circuit 51.

An AND gate 54 performs and AND operation on the output signal of the waveform reshaping circuit 51 and the output signal of an inverter 55 for inverting the output signal of the oscillator circuit 52, so that the output signal pulses of the inverter 55 are passed so long as a "1" level signal is being generated from the waveform reshaping circuit 51 and a "0" level signal is always generated when a "0" level signal is generated from the waveform reshaping circuit 51.

Now referring to a pair of semiconductor switching circuits each being adapted to be turned on and off in response to the input pulse signal, the switching circuits consist of a first switching circuit comprising an NPN power transistor 56, a resistor 58 and a diode 60 and a second switching circuit comprising an NPN power transistor 57, a resistor 59 and a diode 61.

The NPN power transistors 56 and 57 are connected to perform the push-pull operation in response to the outputs of the AND gates 53 and 54. The transistor 56 has its base connected to the output terminal of the AND gate 53 through the resistor 58 and the transistor 57 has its base connected to the output terminal of the AND gate 54 through the resistor 59.

The transistors 56 and 57 are respectively connected through the diodes 60 and 61 to primary terminals 73 and 74 of a transformer 70 and their respective collector terminals C (switch terminals) are respectively connected to the cathodes of the diodes 60 and 61. Also the emitter terminals E (switch terminals) of the transistors 56 and 57 are connected in common to the negative output terminal N of the battery 31 by a conductor $L_1$.

The transformer 70 includes primary and secondary coils 71 and 72 whose turn ratio is about 100:1, and the voltage produced in the primary coil 71 is stepped up and then delivered from the secondary coil 72. The primary terminals 73 and 74 of the primary coil 71 are respectively connected to the anodes of the diodes 60 and 61 and a center terminal 75 is connected to the positive output terminal P of the battery 31 through a conductor $L_2$. The secondary coil 72 has its terminal 76 connected to the spark plug 7 and its terminal 77 grounded.

Figure 4:
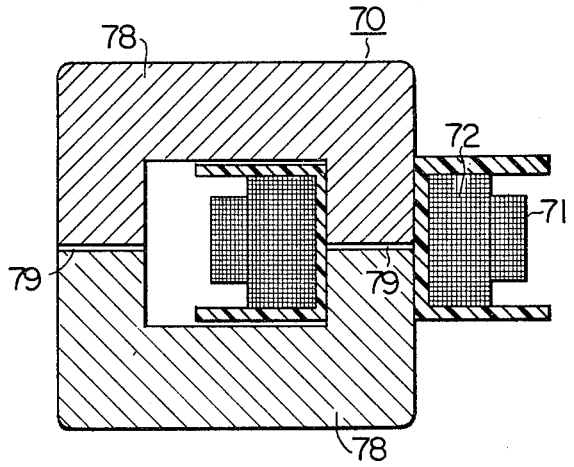
FIG. 4 is a sectional view of the transformer shown in FIG. 3.

As shown in FIG. 4, the primary and secondary coils 71 and 72 are wound on a pair of U-shaped ferrite cores 78 which are wound on a bobbin to form a closed magnetic path, and two air gaps 79 each having a size of about 0.25 mm are provided in the magnetic circuit formed by the ferrite cores 78.

The high-tension generators 22 to 24 are identical in construction with the high-tension generator 21 and will not be described in detail.

With the construction described above, the operation of the embodiment will now be described. When a driver operates the key switch 30 so that the contacts 32 are closed, the voltage regulator 26 comes into operation and a bias voltage is applied to each of the generators 21 to 25. As a result, the oscillator circuit 52 generates a clock signal B as shown in (b) of FIG. 5.

When the driver further operates the key switch 30 so that the preheating contacts 33 are closed for the duration of a time period T, the waveform reshaping circuit 51 generates a "1" level clock signal A as shown in (a) of FIG. 5. When this occurs, the AND gate 53 of the high-tension generator 21 generates a pulse signal as shown in (c) of FIG. 5 and the other AND gate 54 generates a pulse signal as shown in (d) of FIG. 5.

Thus, during the period T in FIG. 5, the pulse signals shown in (c) and (d) of FIG. 5 and opposite in phase to each other are applied to the bases of the power transistors 56 and 57 of the switching circuits and consequently the power transistors 26 and 27 respectively close and open the section between the collector and emitter terminals C and E in phase opposition.

Figure 6:
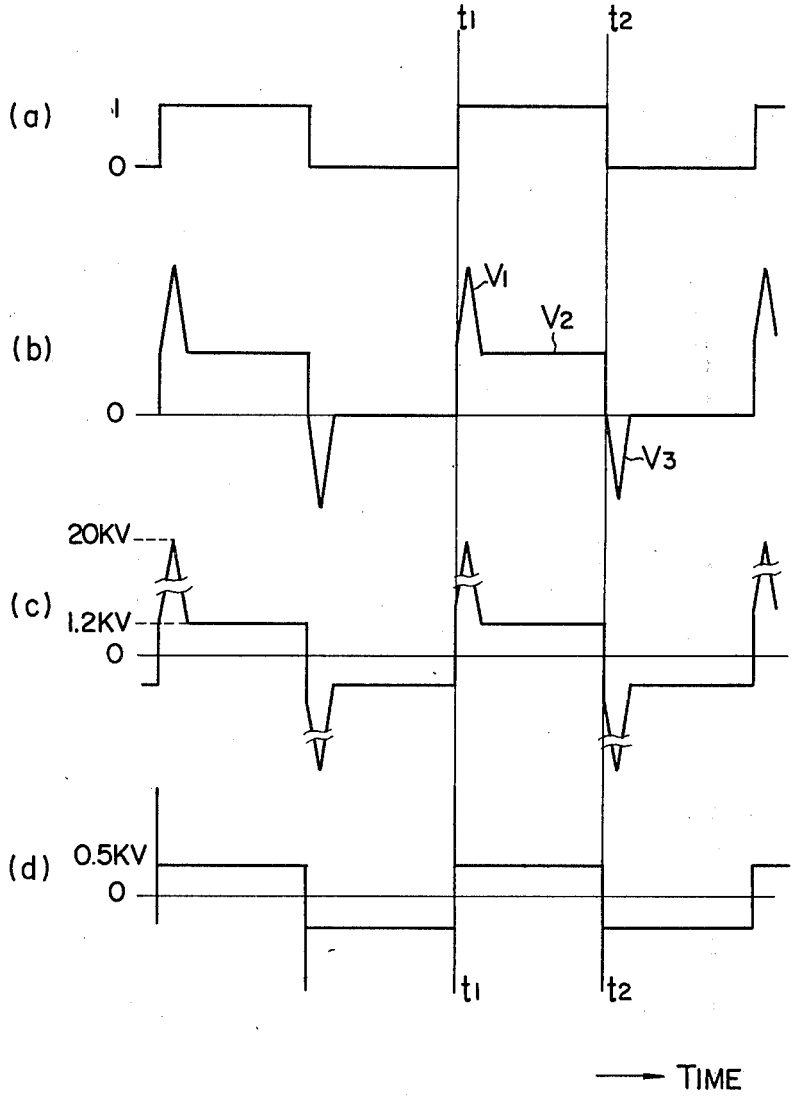

Shown in (a) of FIG. 6 is the waveform generated during the period T and shown in (d) of FIG. 5 with the time base being expanded, and when the output of the AND gate 54 goes from the "0" level to the "1" level at a time $t_1$, the power transistor 56 goes from the "on" to "off" state and the power transistor 57 goes from the "off" to "on" state.

Figure 3:
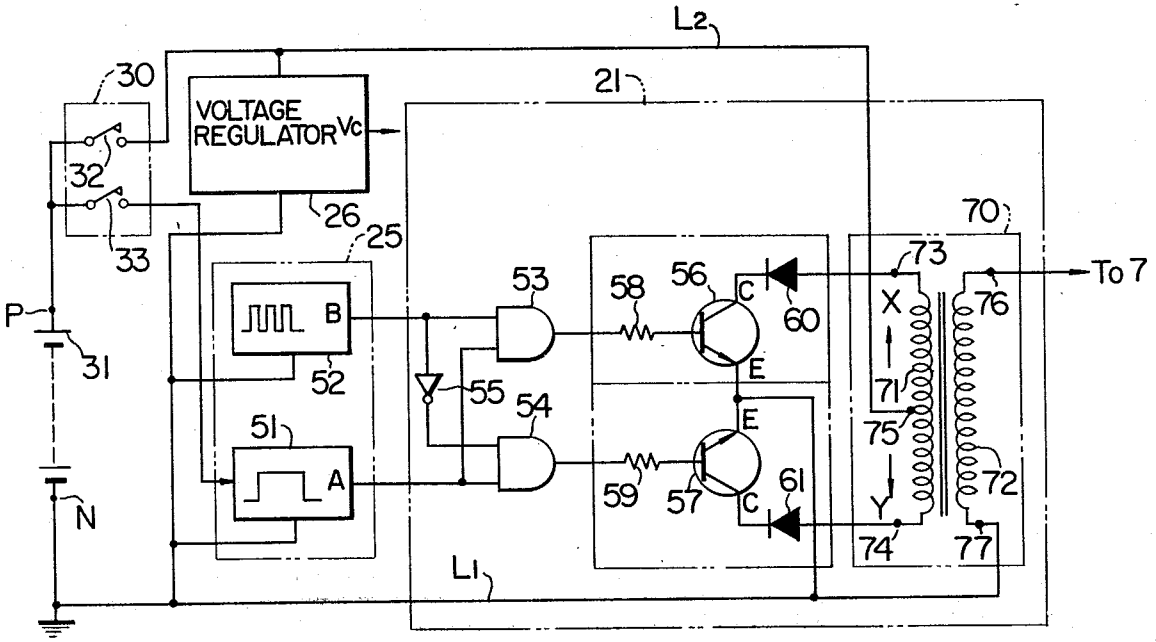
FIG. 3 is a circuit diagram showing the principal parts of the ignition unit shown in FIG. 1.

Even with the power transistor 56 now turned off, the primary current which has been flowing by way of the diode 60 and the power transistor 56 up to the time is not reduced to zero instantaneously and consequently a back electromotive force is produced between the terminals 73 and 74 of the primary coil 71 in the direction of an arrow X in FIG. 3.

In this case, while, without the diode 61, the primary current would flow through the base-collector section of the power transistor 57 thus producing only a low spike voltage at the terminal 73 of the primary coil 71, with the diode 61 being connected between the terminal 74 and the transistor 57, when the power transistor 56 is turned off, the diode 61 prevents the base-collector section of the power transistor 57 from becoming conductive so that a high trigger voltage $V_1$ is generated at the terminal 73 of the primary coil 71 and the voltage then drops to a voltage $V_2$ which is about two times the battery voltage as shown in (b) of FIG. 6.

When the rectangular pulse goes from the "1" to "0" level at a time $t_2$, the power transistor 56 is turned on and the power transistor 57 is turned off.

As a result, the primary current which has been flowing through the diode 61 and the power transistor 57 is cut off and consequently a back electromotive force is produced in the primary coil 71 in the direction of an arrow Y in FIG. 3. Consequently, a negative high trigger voltage $V_3$ is produced at the terminal 73 of the primary coil 71 and then it goes to the ground potential.

Repetitions of the above-described process result in the primary voltage having a waveform such as shown in (b) of FIG. 6. In response to this primary voltage, a stepped-up secondary voltage is produced in the secondary coil 72 of the transformer 70 and the voltage is then applied to the ignition plug 7 of the Diesel engine 1.

In this case, under no-load conditions, a secondary voltage having a waveform as shown in (c) of FIG. 6 is produced at the terminal 76 of the secondary coil 72, whereas when the spark plug 7 is connected the secondary voltage produced has a waveform as shown in (d) of FIG. 6.

As a result, capacity discharge of the ignition plug 7 is caused by the secondary voltage corresponding to the primary voltage $V_1$ and thereafter the ignition plug 7 is caused to continuously discharge for a long period of time by a secondary voltage corresponding to the primary voltage $V_2$.

Thereafter the above process is repeated and the other high-tension generators 22 to 24 operate in the same manner as mentioned previously, thus causing the respective ignition plugs 7 to discharge continuously and stably for a long period of time (the time period T) during which the preheating contacts 33 are closed. Thus, when the fuel is injected into the precombustion chamber 16 from the fuel injection valve 5, the fuel is quickly vaporized and ignited under the effect of the discharge spark.

In other words, under the influence of the discharge spark the fuel injected into the precombustion chamber 16 is greatly activated and the rate of vaporization is increased. Consequently, the combustion of the fuel is facilitated and the combustion is effected intensively at a rate greater than in the past.

What is important here is the fact that a high trigger voltage and a continuous discharge voltage are generated repeatedly and consequently even if the discharge of the ignition plug 7 is interrupted temporarily by the rapid flow of the air and fuel within the precombustion chamber 16, the next high trigger voltage quickly restores the discharge and the discharge is maintained, thus ensuring an improved starting performance with a reduced power consumption.

While, with the prior art glow plugs, the time required for starting an engine at the ambient temperature of 0° C. will be on the order of 10 seconds excluding the preheating time, in accordance with the invention the engine can be started in about 1 to 2 seconds.

After the engine 1 has been started, when the key switch 30 is operated so that the preheating contacts 33 are opened, the waveform reshaping circuit 51 generates a "0" level signal and the high tension generators 21 to 24 come out of operation.

While the above-described embodiment is used in the operation of a four-cylinder engine, the invention can be used in the operation of five-cylinder, six-cylinder or eight-cylinder engine by adding a suitable number of high-tension generators.

Figure 7:
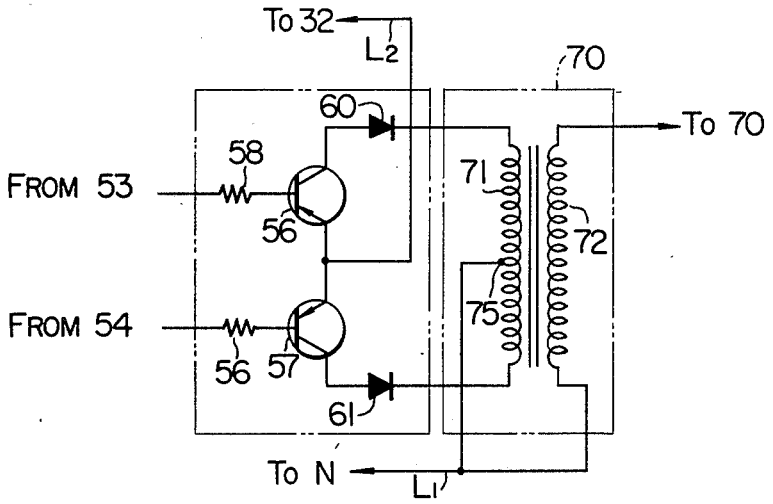
FIGS. 7 and 8 are circuit diagrams showing the principal parts of another embodiment of the invention.

Further, while, in the above-described embodiment, the power transistors 56 and 57 of each switching circuit are of the NPN type, it is possible to use PNP power transistors as shown in FIG. 7 by reversing the connections of the diodes 60 and 61 and by connecting the emitter terminals to the conductor $L_2$ and the center terminal to the conductor $L_1$, respectively.

Further, while the diodes 60 and 61 are used to block a primary coil current due to a back electromotive force produced in the primary coil 71, instead of using the diodes, it is only necessary to use a circuit construction which is designed so that when a back electromotive force is produced in the primary coil 71, the back electromotive force is compensated.

Figure 8:
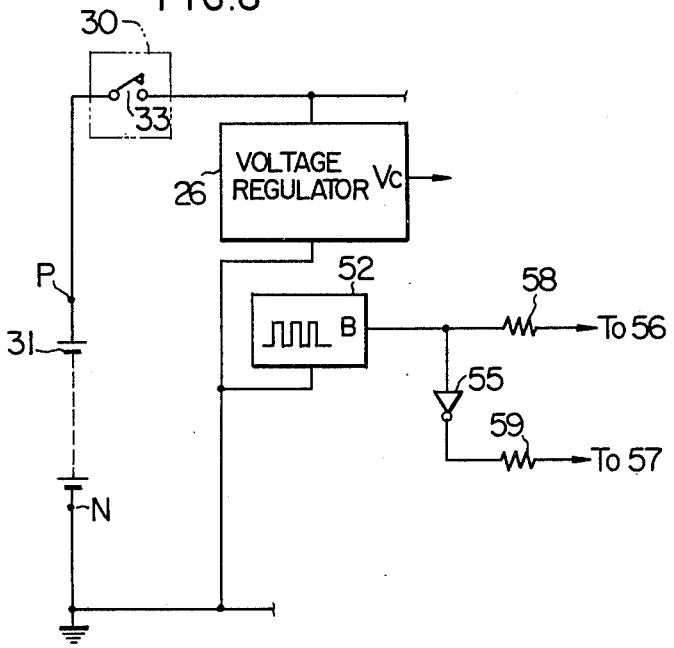

Further, while the contacts 32 are closed to bring the voltage regulator 26 into operation, it is possible to arrange as shown in FIG. 8 so that the voltage regulator 26 is operated in response to the closing of the preheating contacts 33 to serve as a timing or enabling voltage generating means, and the circuit 51 and the AND gates 53 and 54 are eliminated. In this case, the oscillator circuit 52 starts generating a pulse signal in response to the closing of the contacts 33.

We claim:

1. A starting assist system for a Diesel engine having at least one combustion chamber comprising:

a spark ignition plug positioned in said combustion chamber;

a DC power source having a pair of output terminals for generating a DC output;

preheating contacts connected to said DC power source;

ignition means connected to said DC power source through said preheating contacts, responsive to the output voltage of said DC power source upon closing of said preheating contacts for causing said spark ignition plug to discharge;

said ignition means including core means having an air gap; a transformer having a primary coil wound on said core means and having a pair of primary terminals and a center terminal and a secondary coil wound on said core means, said center terminal being connected to one terminal of said DC power source; timing signal generating means connected to said preheating contacts, for generating an output during the closing of said preheating contacts; means, coupled to said timing signal generating means, for generating pulse signals having a constant predetermined frequency during the occurrence of the output of said timing signal generating means; and a switching circuit including first and second switching elements each having a control input, said first switching element coupled at one end thereof to one primary terminal of said primary coil and the other end thereof being adapted to be connected to the other terminal of said DC power source, and said second switching element being coupled at one end thereof to the other primary terminal of said primary coil and at the other end thereof being adapted to be connected to said other terminal of said DC power source; and diodes connected to said primary coil, for preventing an inverse current from flowing therein;

said control inputs being coupled respectively to said pulse signal generating means for receiving therefrom said pulse signals for controlling said switching elements to turn on and off an electric current through said primary coil alternately in response thereto, whereby during a time that said preheating contacts are held closed, there is induced across said secondary coil an AC pulse voltage containing a peaked high voltage of one polarity, at each leading edge thereof, sufficient to trigger a discharge of said spark plug, a subsequent high voltage sufficient to maintain the discharge of said spark plug, followed by a peaked high voltage of polarity opposite to said one polarity sufficient to trigger a discharge of said spark plug.

2. A system as set forth in claim 1, wherein the constant predetermined frequency of said pulse signals generated by said means for generating pulse signals is substantially on the order of 5 KHz.

3. A system as set forth in claim 1, wherein said pulse signal generating means includes:

an oscillator circuit for generating clock pulses of the constant predetermined frequency; and means connected to said timing signal generating means and said oscillator circuit, for performing a logical operation on the outputs of said timing signal generating means and said oscillator circuit to generate said pulse signals.

4. A system as set forth in claim 1, wherein said timing signal generating means is a voltage regulator, responsive to the closing of said preheating contacts for causing said pulse signal generating means to generate said pulse signals.

5. A system as set forth in claim 1, wherein said peaked high voltage is of greater magnitude than that of said subsequent high voltage.

6. A system as set forth in claim 1, wherein each of said switching elements includes a power transistor connected to be turned on and off in response to said pulse signal of said pulse signal generating means; and wherein each of said diodes is connected to block a primary current caused by a back electromotive force produced in said primary coil.

7. A system as set forth in claim 6 or 1, wherein said combustion chamber is divided into a main combustion chamber and a precombustion chamber which are communicated with each other, and wherein said spark ignition plug is positioned in the vicinity of a fuel injection valve located in said precombustion chamber.

8. A starting assist system for a Diesel engine having at least one combustion chamber comprising:

a spark ignition plug positioned in said combustion chamber;

a DC power source having a pair of output terminals for generating a DC output;

preheating contacts connected to said DC power source;

ignition means connected to said DC power source through said preheating contacts, responsive to the output voltage of said DC power source upon closing of said preheating contacts for causing said spark ignition plug to discharge;

said ignition means comprising a magnetic core having a gap therein;

a primary coil wound on said magnetic core and having two end terminals and a center tap, the center tap being adapted to be connected to one end of said DC power source;

a secondary coil wound on said magnetic core and being adapted at one end to be connected to the spark ignition plug;

timing signal generating means connected to said preheating contacts, for generating an output during the closing of said preheating contacts;

means, coupled to said timing signal generating means and to said primary coil, comprising:

means for generating a pulse signal, a push-pull stage, coupled to said pulse signal generating means and to said timing signal generating means, having two outputs respectively coupled to said two end terminals of said primary coil, and a pair of diodes, one such diode coupling each of said outputs of said push-pull stage to an end terminal of said primary coil, said ignition generator means for (a) inducing across said secondary coil, during the time said preheating contacts are held closed, an AC pulse voltage having, at its leading edge, a peaked high voltage of one polarity sufficient to trigger a spark discharge of said spark plug, and (b) inducing across said secondary coil, subsequent to said peaked high voltage, a high voltage sufficient to maintain the spark discharge of said spark plug; and then (c) inducing across said secondary coil at the trailing edge of said AC pulse voltage a peaked high voltage of polarity opposite to said one polarity sufficient to trigger a spark discharge of said spark plug.

* * * * *